US010839778B1

(12) United States Patent
Reid

(10) Patent No.: US 10,839,778 B1
(45) Date of Patent: Nov. 17, 2020

(54) CIRCUMAMBIENT MUSICAL SENSOR PODS SYSTEM

(71) Applicant: Everett Reid, Chicago, IL (US)

(72) Inventor: Everett Reid, Chicago, IL (US)

( * ) Notice: Subject to any disclaimer, the term of this patent is extended or adjusted under 35 U.S.C. 154(b) by 0 days.

(21) Appl. No.: 16/440,831

(22) Filed: Jun. 13, 2019

(51) Int. Cl.
*G10H 1/00* (2006.01)
*G10H 1/055* (2006.01)

(52) U.S. Cl.
CPC ..... *G10H 1/0008* (2013.01); *G10H 1/055* (2013.01); *G10H 2220/201* (2013.01)

(58) Field of Classification Search
CPC . G10H 1/0008; G10H 1/055; G10H 2220/201
USPC ..... 84/626
See application file for complete search history.

(56) References Cited

U.S. PATENT DOCUMENTS 6,388,183 B1 * 5/2002 Leh ..... G10H 1/0008 84/645
10,146,501 B1 * 12/2018 Park ..... G06F 3/165
10,228,767 B2 * 3/2019 Hampiholi ..... G06F 3/017
2007/0028749 A1 * 2/2007 Basson ..... G10H 1/0091 84/601
2012/0272162 A1 * 10/2012 Surin ..... H04L 67/38 715/753
2013/0005467 A1 * 1/2013 Kim ..... A63F 13/10 436/36
2013/0084979 A1 * 4/2013 Casino ..... A63F 9/24 463/31
2014/0358263 A1 * 12/2014 Irmler ..... G06F 3/014 700/94
2015/0287403 A1 * 10/2015 Holzer Zaslansky ... G10L 21/10 704/231
2015/0331659 A1 * 11/2015 Park ..... G10H 1/0008 700/94
2016/0225187 A1 * 8/2016 Knipp ..... G06T 19/006
2017/0028295 A1 * 2/2017 Patton ..... G07F 17/32
2017/0028551 A1 * 2/2017 Hemken ..... B25J 11/009
2017/0047053 A1 * 2/2017 Seo ..... G10H 1/0091
2017/0093848 A1 * 3/2017 Poisner ..... A63F 13/98
2017/0117891 A1 * 4/2017 Lohbihler ..... G08C 17/02
2017/0195795 A1 * 7/2017 Mei ..... H04R 5/04
2017/0316765 A1 * 11/2017 Louhivuori ..... G10H 1/0008
2017/0336848 A1 * 11/2017 Aoyama ..... G06F 3/162
2018/0089583 A1 * 3/2018 Iyer ..... G06F 3/14
2018/0124497 A1 * 5/2018 Boesen ..... H04R 1/1091
2018/0275800 A1 * 9/2018 Hu ..... G06F 1/1632
2018/0301130 A1 * 10/2018 Kudoh ..... G10H 1/00
2018/0336871 A1 * 11/2018 Hamalainen ..... G10H 1/368
2018/0357942 A1 * 12/2018 Lin ..... G09G 3/001

FOREIGN PATENT DOCUMENTS

WO WO-2009007512 A1 * 1/2009 ..... A63H 5/00

* cited by examiner

*Primary Examiner* — David S Warren
*Assistant Examiner* — Christina M Schreiber

(57) ABSTRACT

A circumambient configuration of sensor pods is disclosed, focusing on a percussionist or other musical performer, to effect desired sound effects. The configuration is ergonomically and/or ergodynamically advantageous as proximate to performer as each sensor pod is within a natural reach of the performer performing conventionally on associated instruments, if any.

20 Claims, 3 Drawing Sheets

CIRCUMAMBIENT MUSICAL SENSOR PODS SYSTEM

TECHNICAL FIELD

The subject matter described herein generally relates to musical instruments, and in particular, to gestural control of modifications of percussive sounds.

BACKGROUND

Percussion is commonly referred to as "the backbone" or "the heartbeat" of a musical ensemble. A percussionist (especially, a drummer) generated and kept the beat or pulse for a musical band—other band members and the audience, would focus and try to get "locked into" that beat or pulse But music and performance evolve. Certainly in jazz today, percussion has moved from mere time-keeping to where percussion participates in what happens between the beats. While in a jazz band, the bassist remains (at least as of the date of the presentation of this invention) the temporal sentry (beating a regular pulse for "communal time"), a jazz percussionist may start to "play around" or "dance around" those bassist pulses, not necessarily always marking it in the percussive playing but implying that (communal) pulse. Whether jazz or any successful musical ensemble, the key objective is the blending of individual musicians and their respective instruments, their respective temporal inclinations, their heterogeneous "musicalities", etc., into a holistic sound from the ensemble. The present invention "unshackles" the percussionist (especially the drummer) from strict "metronome" duties and from the restrictions and difficulties imposed by the dials, computer keyboards, slide knobs and the like of conventional sound modification equipment, and does so by adding the facility to participate "between" and "around" the (bassist) beats by massaging the percussive sounds in response to natural (i.e. technology unaided) hand and body gestures.

Prior attempts for generating sound effects responsively to a performer's gestures, might include the following (with their limitations noted) that the present inventor is aware of in varying degrees of knowledge. After the Russian Revolutions and Civil War, there was theremin (originally known as the thereminophone, termenvox/thereminvox) (see https://en.wikipedia.org/wiki/Theremin accessed Jun. 12, 2019). More recently, moving the hands around a small "box" with outward facing, discrete sensors on the box sides (apparently used by the electronic musical artist known as "Pamela Z") has obvious physical limitations to the performer's ability to bodily express (because the hands must remain very proximate or return to the single box). Another attempt apparently equips the performer with sensor-equipped gloves (called "Mi.Mu" gloves by the artist, Imogen Heap)—the limitation appears to be in the specificity of sensors and their location (around the hand/fingers that measure the bend of each finger). In a different genre of gesture controlled music, the body "poses" of playing an "air guitar" (i.e. a virtual guitar) are captured by video camera for a gesture-controlled musical synthesis that responsively plays pre-recorded "licks" (patent application WO 2009/007512 filed by Virtual Air Guitar Company Oy)—the complexity of camera and software apparently implicated, is intimidating and also not helpful for percussive purposes.

SUMMARY

In an aspect of the invention, a method is disclosed for a percussionist to effect desired sound effects, comprising the steps of: defining a hand gesture of the percussionist, defining a desired sound affect and associating said defined hand gesture with said desired sound effect; and locating a plurality of sensor pods around the percussionist, wherein each sensor pod is capable of sensing said a movement of the percussionist as said defined hand gesture; and presenting said desired sound effect.

In another aspect of the invention, a system is disclosed for a percussionist to effect desired sound effects, comprising: a) a plurality of sensor pods located in an circumambient relationship with the percussionist where each said sensor pod is adapted to sense movements of the percussionist; b) a gesture defined as a particular movement of percussionist; c) a gesture recognition component for interpreting said sensed movements and identifying it as said gesture; d) sonic means for presenting sound effects responsive to said identified gesture.

DESCRIPTION OF DRAWINGS

Like reference symbols in the various drawings indicate like elements.

DETAILED DESCRIPTION

Figure 1:
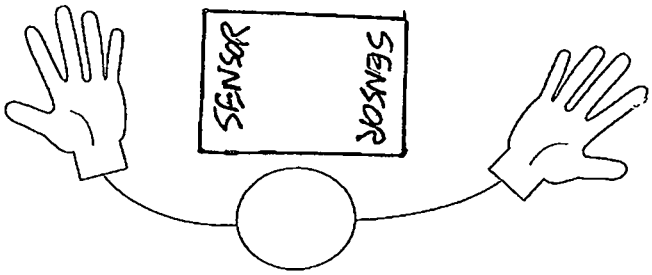
PRIOR ART FIG. 1
FIG. 1 is a conceptual drawing of a top view of the configuration of the performer (with exaggerated hands) relative to (single "box") sensors according to prior art.

Sensor-equipped boxes are known in the prior art. As shown conceptually in FIG. 1, the performer moves his/her hands over a box whose sides have sensors, and thereby may generate sound effects. The focal point of sound management is a central collection of sensors and the performer (and hands) move about that focal point.

Figure 2:
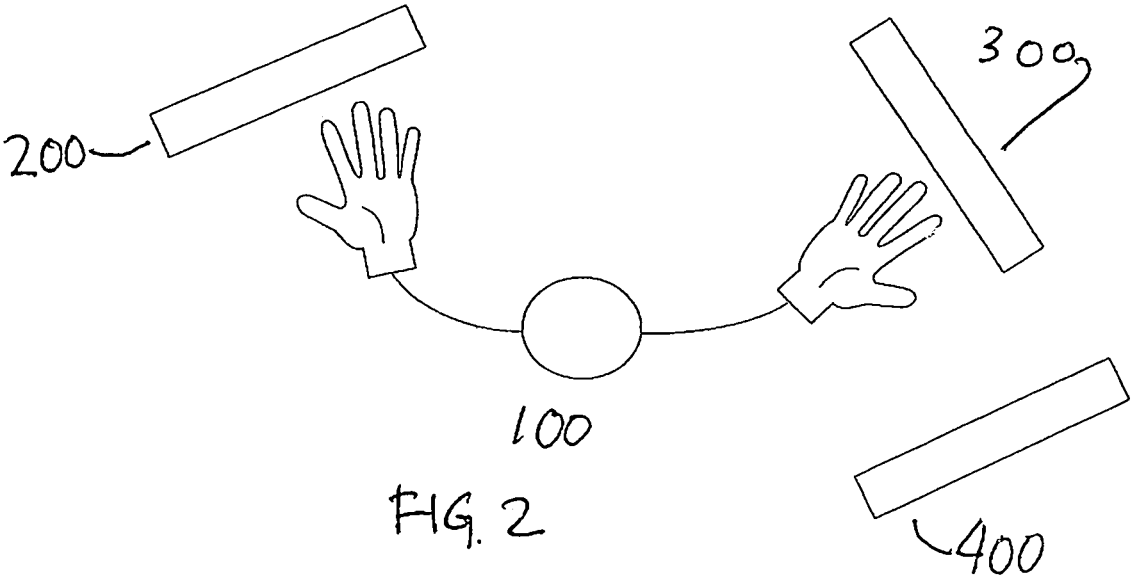
FIG. 2 is a conceptual drawing of a top view of the configuration of the sensors relative to the performer (with exaggerated hands) according to the present invention.

In contrast, the present invention teaches a different geometric configuration of sensors relative to the performer. As shown in FIG. 2, drummer 100 is shown notionally (with exaggerated hands) and is surrounded by sensor pods 200, 300 and 400. For economy of illustration and immediate perception of the differences of the present invention over FIG. 1 (prior art), FIG. 2 is simplified in not showing distractions like a typical drum set and common equipment (e.g. sound mixers and equalizer consoles). The invention is not restricted to a drummer with a drum set—more generally, the invention applies to a percussionist with a set of percussive instruments (including cymbals, triangles, tambourine, pitched or unpitched instruments, etc.). But for ease of explanation, the explanation below continues with drummer 100 (and a notional drum set, not shown), and later it will be explained that the present invention has applicability beyond percussive instruments.

A typical drum set is set up as stationary at a particular location for a performance, and the drum set's pieces are located circumambient about the drummer at locations that are ergonomically advantageous (or ergodynamically advantageous when the kinetic nature of his performance is considered), where drummer 100 remains substantially stationary (with the exceptional local, near-field movements of limbs, torso, head). Herein, for illustrative purposes only, drummer 100 represents not only the human drummer (and in particular, his/her moving body parts, especially (but not restricted to) the hands), drummer 100 also represents the orientation focal point for the present invention, especially the geometric configuration of sensor pods, introduced next.

FIG. 2 shows three sensor pods 200, 300, and 400 in circumambient configuration about drummer 100. Sensor pods 200 and 300 are oriented towards (the face, not shown) of drummer 100 and are proximate to left and right hands respectively. Sensor pod 400 is located slightly right-rearwardly of drummer 100 (and may be orientated towards the head of drummer 100, as explained below). Overall, the circumambient configuration of sensor pods 200, 300, and 400 (and of the drum set components, not shown) resembles a cock-pit presentation of a commercial airplane, where all the discrete components of information and of control are designed to be within the seamless reach, quick responsiveness, reliable reception and correct coordination for the airplane pilot. This invention's "percussion/musical cockpit" configuration of sensor pods (with or without drums or other musical instruments) is visually evident in FIG. 2.

Although the principles of this invention are applicable to a configuration of one sensor pod or of four or more sensor pods (depending on context, desired effects and the like), a set of three sensor pods provides, for explanatory purposes, an effective configuration of the percussive participation of this invention in a small jazz ensemble. Sensor pods 200, 300, and 400 are shown in electric signals communications with micro-controller 500 which in turn is in electrical signals communications with managing computer 600. FIG. 2 is a conceptual representation of various components of the system. Practically, the physical distance between drummer 100 and each of pods 200, 300, and 400 must be at least sufficient for the extremities of drummer 100 (in most cases, his/her hands) to be freely movable as desired by drummer 100 without unwanted physical disturbance of any pod (in many cases, within a meter of drummer 100's hands which are typically proximate the drums). Practically, sensor pods 200, 300, and 400 are located relative to drummer 100 in a configuration (factored by physical proximities and natural hand/body movements as may be made in a typical drumming performance on a drum set) that is substantially similar to how the drum set components (not shown) are arranged about drummer 100—i.e. ergodynamically advantageously so that only natural movements of drummer 100 (i.e. no very unusual or awkwardly effected hand/body actions are implicated) will produce desired sound effects (in supplement of replacement of (some or all) conventional actions to play the drum set). Shown are sensor pods arranged in an approximate semi-circle (with each sensor pod directed toward drummer 100, so a sensor pod is either front of drummer 100 or towards the side within each hand reach). Other geometrical configurations are possible depending on context (the physical limitations imposed by the size of the performance room/stage/floor, the presence of other musicians, the sensitivity/range of the sensor pods, the physical constraints imposed by the drum set or percussive instruments, and the like). Important is that any plurality of the sensors are positioned circumambient around drummer 100 to focus the sensor sensing on hand (and other body) movements.

Figure 3:
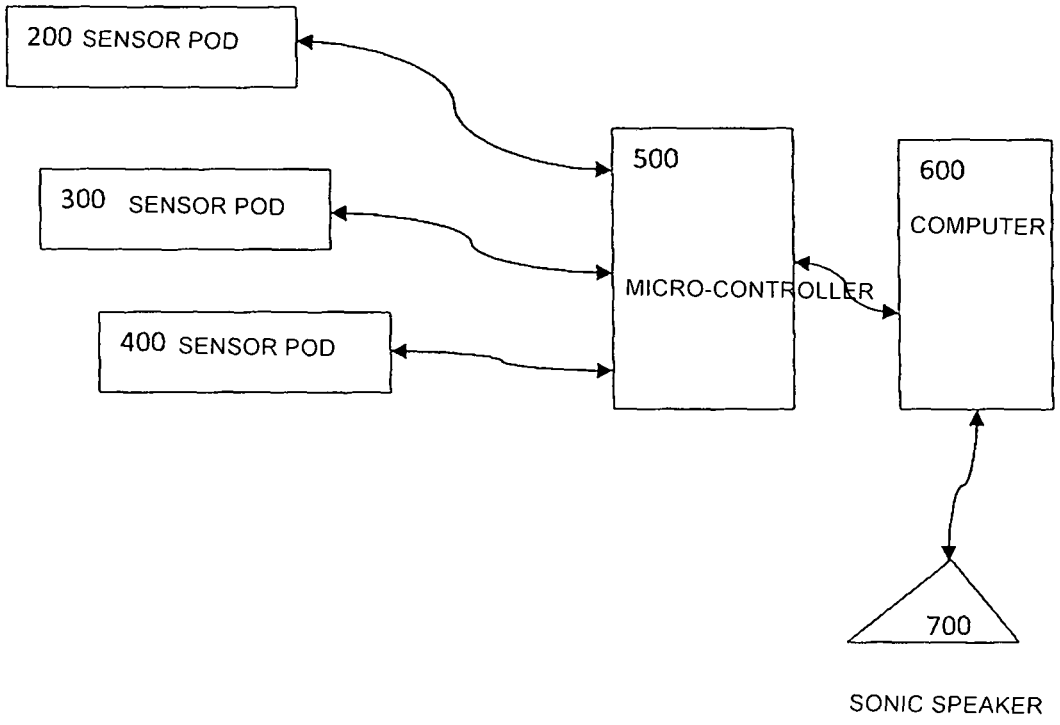
FIG. 3 is a block diagram of components of the system, in electrical signal communications therebetween, according to the present invention.

FIG. 3 shows a conceptual block diagram of sensor pod 200 (as representative of other sensor pods 300 or 400, for which repetition of explanation will be skipped unless the context requires otherwise). Sensor pod 200 has distance sensor 201 and gesture sensor 202. Sensor pod 200 also has visual feedback 203—this is optional as providing visual esthetics to the audience and stimulation to drummer 100 but is not required for this invention whose essence is to ergodynamically manipulate and present sound effects. That said, giving visual feedback to performer is useful (explained below).

Each sensor pod 200, 300 or 400 has its own unique characteristics as programmed for desired results of sonic output.

Sensor pod 200 may be programmed to process—and/or add effects to—live sounds from microphonic input (e.g. singing). Waving the hand back and forth in front of sensor pod 200, changes the degree of effect (e.g. if hand is far away, the drums sound like being played in a canyon; up close, they sound like they're in a bottle).

| Hand Gesture | Sound effect |
|---|---|
| Close/far | Close >> small degree of effect (short delay, "small bottle" sound, etc.)<br>Far >> big degree of effect (long delay, "big canyon" sound, etc.) |
| Left/right | Left >> Delay Effect<br>Right >> Reverb ("bottle" vs. "canyon") |
| Up/down | Up >> Filter Effect (between two extremes of an "open" sound and "closed" sound i.e. https://www.youtube.com/watch?v=WLDbrn-hfGc accessed Jun. 11, 2019)<br>Down >> pod off/no sound |

Sensor pod 300 may be programmed for control of synthesized sounds. E.g. moving the hand back/forth or forward/back, different notes can be assigned to different spatial separations of hand-sensor. Across the spectrum from hear to far, the following sound effects (musical notes) can be parameterized:

100 mm>>Note C1
200 mm>>Note D1
300 mm>>Note E1
400 mm>>Note F1
500 mm>>Note G1

Sensor pod 400 may be programmed for (rhythmic, stutter) samples (e.g. when hand is far away, the stutters are rapid and high pitched, and when up close, they are slow and pitched lower).

| Hand Gesture | Sound effect |
|---|---|
| Close/far | Slow, low pitch/rapid, high pitch |
| Left/right | Left >> sound effect #1<br>Right >> sound effect #2 |
| Up/down | Up >> sound 3<br>Down >> pod off/no sound |

Each sensor pod can be programmed differently for different sound effects as desired by drummer 100 but the basic paradigm is that a plurality of different qualities and modalities of affecting or actuating sound, is effected by sensing the movements of the hands of drummer 100 by sensor pods directed at him/her and body parts movements. Three examples of sensor pods and associated sound effects have been given but they are taken from a full complement of musical elements and corresponding sound effects—rhythm (e.g. beat, meter, tempo, syncopation, polyrhythm); dynamics (e.g. crescendo, decrescendo; forte, piano); melody (e.g. pitch, range, theme); harmony (e.g. chord, progression, key, tonality, consonance, dissonance); tone color (e.g. register, range); and texture (e.g. monophonic, polyphonic, homophonic). Hand and other body movements can be recognized as gestures which, with suitable programming, implicate sound effects as desired from the above wide range of sound effects.

Above, reference is mainly made to the hands. A hand is merely one, articulated body part. More generally, other body parts, movements, attributes can be sensed. A symphony orchestra conductor may, in addition to the hand (and its extension, the baton), use the rotation of the head, the sway of the torso/shoulders and the like (and even leg movements, as has been observed of some kinetic orchestra conductors).

This invention's sensor pods can be physically adjusted (relative to drummer 100) and then programmed to track non-hand body parts (and, for examples, their radial extensions, angular positions, height, speed and related). Hand gestures described herein can be replaced or supplemented by head gestures. For examples, the following head gestures can be sensed by sensor pods (suitably located relative to the head) and the desired sound manipulations can be programmed—nodding forward/backward (looks like "yes"); Rotating left/right (looks like "no"); Tilt left/right. Other examples include the movement of the torso in a "Swan Lake"-like ballerina dive or in a Maori haka dance—like stomping of the feet, as sensed by suitably located sensor pods.

Earlier, it was explained the drum set was not illustrated in FIG. 2 as being a distraction in the explanation against highlighting the geometric configuration difference that distinguishes the invention from prior art. In practice, the drums (and/or other percussive instruments) are optional—they (and any other musical instrument) are not required for the fulfilling experience of a performer (any musical performer) "playing" the (circumambient, "cockpit"-like) configuration of sensor pods. For example, without any conventional musical instruments, the present invention can be performed to audience experiential satisfaction. With suitable programming, this' invention creates and empowers the "virtual" version bf the "one man band" of an earlier era (where a single performer uses a plurality of body parts to make music). For example, with suitable programming, sensor pod 300 responds to make and output melodies (i.e. the same role a real trumpet would play), sensor pod 200 generates chords (i.e. what a piano would do), and sensor pod 400 generates rhythmic/stutter effects.

The present invention's configuration of sensor pods (their location and their sensing orientation ("Field of View") in 3-D space relative to performer) is designed to minimize the performer's "reach time", whether physical or mental or both. On the mental aspect, sensor pods 200, 300 and 400 may be advantageously "labeled" for performer's ease of reference during performance. In a way that resembles how a piano keyboard has means for easy identification of each key for the pianist (the first level of identification of a key is the black/white color scheme, followed by its location relative to other keys) to associate with its particular piano note or sound, a sensor pod's "label" in the present invention may be a physical label with words (in an initial implementation, the sensor pods were identified with colors (gold, silver, black)); or could be painted accordingly to a scheme devised by the drummer according to his/her particular preferences. Advantageous is an identifying labeling or other visual mnemonic device for a sensor pod that is associated—in the mental processing of the performer—to its particular characteristics and functions and desired outputted sound effects. In the middle of performing, the performer is using the sensor pods of the present invention, as an extension of his/her body/mind, and so should not be retarded by having to think much about which sensor pod was for what sound effect, its location and its gestures for its sound effects. The "visual labeling" of sensor pods is designed and programmed by the performer to fit his/her genre of music, his/her personal skills (maximize strengths and minimize weaknesses), his/her musical inclinations and tendencies (e.g. a set of "go to" effects) and the like (and perhaps considered in conjunction with his/her musical ensemble members and their personal musical traits).

In an example implementation, distance sensor 201 (for sensing sensor-hand distance, i.e. for hand closer/farther from sensor) may be based on an Adafruit VL53L0X "Time of Flight" Distance Sensor using a laser and corresponding reception sensor (https://www.adafruit.com/product/3317, accessed on Jun. 11, 2019).

In an example implementation, gesture sensor 202 (for sensing hand gesture (e.g. swipe left/right) may be based on SparkFun RGB and Gesture Sensor—APDS-9960. That sensor provides ambient light and color measuring, proximity detection, and touchless gesture sensing (https://www.sparkfun.com/products/12787, accessed on Jun. 11, 2019).

Figure 4:
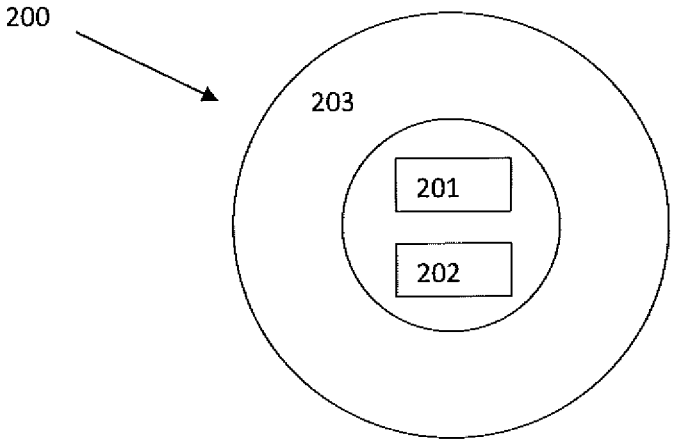
FIG. 4 is a block diagram of components of the sensor pod according to the present invention.

In FIGS. 3 and 4, sensor pods 200, 300, and 400 are shown in electric signals communications with micro-controller 500 which in turn is in electrical signals communications with managing computer 600 running (off-the-shelf and/or customized) music synthesis/management software. Computer 600 (and its software), in turn, is in electrical signals communication with (sonic) speakers 700 to present the desired sound effects (and with visual feedback 203 LEDs of the sensor pods). Such electrical signals communications are implemented conventionally (e.g. wired or wirelessly by Wi-Fi or related technology suitable for short range communication, with attendant (dis)advantages related to cost, degree of mobility of (re)locating sensor pods, and the like).

Visual feedback 203, implementable in LEDs, can provide, in addition to "disco ball" visuals, practical information to the performer. The distance information from distance sensor 201 of sensor pod 200, can be visually informed to the performer about how far the performer is from sensor pod 200—e.g. based on where/when/which LEDs stop shining. Programming for such visual feedback is effected in software in computer 600.

References herein to "programming" and cognate terms, are effected by the software running in computer 600. In an example implementation, micro-controller 500 may be based on an (open source hardware/software) Arduino device. The music and audio-visual synthesis/management software running on computer 600 may be Max/MSP (https://cyeling74.com accessed on Jun. 11, 2019) and is an easy, visual programming language for drumner 100 to use for desired sound effects according to this invention. The above example implementations of sensor pods 200, 300, 400 (including visual feedback 203 LEDs), micro-controller 500, and music synthesis/management software, are cost-conscious, "off the shelf" implementations, the total expense thereof being within the means of a "student-musician".

Although the above implementation details have been found to be very suitable for the inventor's current purposes of a small jazz ensemble, they are not limiting of the invention. Many other implementations are possible and in fact, technical improvements are anticipated to continue from the electronics industry. For example, this invention may be implemented with distance sensors that are sonars or are heat sensitive or are based on radio-frequency technology operable in the range of several or many meters of drummer 100 or has greater Field of View scope, and so on. Furthermore, although the above implementation examples are for each, sensor pod 200; 300 and 400 operating separating, the quality of calculation of distance (and thus the granularity quality of identifying movements as performer's intended gestures) can be improved by using (e.g. trilateration techniques with) the combination of signals outputted from the plurality of sensor pods (not unlike how GPS uses such techniques to calculate precise locations on the planet surface).

In an example implementation, visual feedback 203 may be an LED strip that displays desired visuals based on the distance sensor output information and the gesture sensor status output, based on Adafruit DotStar Digital LED Strip (https://www.adafruit.com/product/2241 accessed on Jun. 11, 2019). Visual feedback 203 LEDs may be programmed by drummer 100 using micro-controller 500 and/or Max/MSP software on computer 600.

The present invention's configuration of sensor pods (their location in 3-D space and their sensing orientation (of Field of View) in 3-D space, relative to performer) is designed to minimize the performer's "reach time" (for playing instruments or even the sensor pods themselves). Accordingly, each sensor pod has its own (e.g. floor- or desk-) mountable stand or other means for securing stably in 3-D space relative to drummer 100, and may be conventionally adjustable in height, separation and/or angular sensing orientation relative to relevantly targeted body parts of drummer 100 for maximally accurate sensing of the movements thereof. The final configuration of sensor pods 200, 300 and 400 in 3-D space (i.e. their heights and separation, angular orientations, and the like, all relative to the performer's body) will take into account other physical limitations (such as the presence of percussive instruments or the amount and geometry of free space available proximate the performer in a real performing context within a venue and with other bodies).

Gesture sensor 202 is not strictly necessary as a discrete component of sensor pod 200 if distance sensor 201 outputs data in quantity/quality/time that can be used by computer 600 software that is programmed to infer whether certain movements should be recognized as a gesture of drummer 100. In other words, the work of gesture sensor 202 to recognize a gesture, can be accomplished by software running on computer 600 using only data from distance sensor 201, especially using a combination of outputs of the distance sensors of three sensor pods. Thus, some gestures that might be difficult to capture with a plurality of dedicated gesture sensors, may be recognized with suitably programmed software running on computer 600—for example, some of the (multi-articulated and un-stereotypical) "swirling" of a symphony orchestra conductor, can be recognized to produce desired sound effects.

In the descriptions above and in the claims, phrases such as "at least one of" or "one or more of" may occur followed by a conjunctive list of elements or features. The term "and/or" may also occur in a list of two or more elements or features. Unless otherwise implicitly or explicitly contradicted by the context in which it is used, such a phrase is intended to mean any of the listed elements or features individually or any of the recited elements or features in combination with any of the other recited elements or features. For example, the phrases "at least one of A and B;" "one or more of A and B;" and "A and/or B" are each intended to mean "A alone, B alone, or A and B together." A similar interpretation is also intended for lists including three or more items, For example, the phrases "at least one of A, B, and C;" "one or more of A, B, and C;" and "A, B, and/or C" are each intended to mean "A alone, B alone, C alone, A and B together, A and C together, B and C together, or A and B and C together." In addition, use of the term "based on," above and in the claims is intended to mean, "based at least in part on," such that an unrecited feature or element is also permissible.

The subject matter described herein can be embodied in systems, apparatus, methods, and/or articles depending on the desired configuration. The implementations set forth in the foregoing description do not represent all implementations consistent with the subject matter described herein. Instead, they are merely some examples consistent with aspects related to the described subject matter. Although a few variations have been described in detail above, other modifications or additions are possible. In particular, further features and/or variations can be provided in addition to those set forth herein. For example, the implementations described above can be directed to various combinations and subcombinations of the disclosed features and/or combinations and subcombinations of several further features disclosed above. In addition, the logic flows depicted in the accompanying figures and/or described herein do not necessarily require the particular order shown, or sequential order, to achieve desirable results. Other implementations may be within the scope of the following claims.

What is claimed is:

1. A method for a musical performer with extremities of hands and head to effect desired sound effects, comprising the steps of:

a) defining an extremities gesture of the performer, defining a desired sound effect and associating said defined extremities gesture with said desired sound effect; and b) locating a plurality of sensor pods circumambiently around the performer, wherein each said sensor pod is separated from performer's extremities by a minimum distance sufficient to permit free movement of performer's extremities and wherein each said sensor pod has an orientation that is focused on performer's extremities and wherein each said sensor pod senses a movement of the performer for said extremities gesture and wherein each said sensor pod is associated with the generation of its sound effect; and c) responsively to a sensed extremities gesture, generating said sound effect associated with each said sensor pod.

2. The method of claim 1, wherein one said sensor pod has a sensor that senses an extremities gesture made by the performer.

3. The method of claim 2, wherein said locating of said sensor pods includes the minimization of the reach time of performer's extremities towards said sensor pods.

4. The method of claim 3, wherein one said sensor pod is adjustable in height, separation and/or angular sensing orientation relative to the performer.

5. The method of claim 4, wherein said plurality of sensor pods are at least three in number and said sensing of performer's extremities gestures is calculated by trilateration using the combination of sensing from each of said three sensor pods.

6. The method of claim 3, wherein two said sensor pods are labeled in a visually mnemonic and contrasting way to each other.

7. The method of claim 6, wherein said visually mnemonic and contrasting way, comprises associating different colors respectively to said two sensor pods.

8. The method of claim 3, wherein one said sensor pod has a sensor that senses distance between performer's extremities and said sensor pod and provides visual feedback to performer based on said sensed distance.

9. The method of claim 1, wherein one said sound effect is a reverberation of a live input sound.

10. The method of claim 1, wherein one said sound effect is a stuttering of a sound.

11. A method for a musical performer with extremities of hands and head to effect desired sound effects, comprising:

a) a plurality of definitions of extremities gestures of the performer;

b) a plurality of desired sound effects that are associated with said defined extremities gestures;

c) a plurality of sensor pods located circumambient around the performer, wherein each said sensor pod is separated from performer's extremities by a minimum distance sufficient to permit free movement of performer's extremities and wherein each said sensor pod has an orientation that is focused on performer's extremities and wherein each said sensor pod senses a movement of the performer for said extremities gesture and wherein each said sensor pod is associated with the generation of its sound effect; and d) sound effect generator that, responsively to an extremities gesture sensed by one said sensor pod, generates said sound effect associated with said sensor pod that sensed.

12. The system of claim 11, wherein one said sensor pod has a sensor that senses an extremities gesture made by the performer.

13. The system of claim 12, wherein said sensor pods are located to minimize the reach time of performer's extremities towards said sensor pods.

14. The system of claim 13, wherein one said sensor pod is adjustable in height, separation and/or angular sensing orientation relative to the performer.

15. The system of claim 14, wherein said plurality of sensor pods are at least three in number and said sensing of performer's extremities gestures is calculated by trilateration using the combination of sensing from each of said three sensor pods.

16. The system of claim 13, wherein two said sensor pods are labeled in a visually mnemonic and contrasting way to each other.

17. The system of claim 16, wherein said visually mnemonic and contrasting way, comprises associating different colors respectively to said two sensor pods.

18. The system of claim 13, wherein one said sensor pod has a sensor that senses distance between performer's extremities and said sensor pod and provides visual feedback to performer based on said sensed distance.

19. The system of claim 11, wherein one said sound effect is a reverberation of a live input sound.

20. The system of claim 11, wherein one said sound effect is a stuttering of a sound.

* * * * *